US005494181A

United States Patent [19]

Denney

[11] Patent Number: 5,494,181

[45] Date of Patent: Feb. 27, 1996

[54] ROLL-TOP CEDAR CHEST

[75] Inventor: Jon K. Denney, Mountain Lake, Minn.

[73] Assignee: Conestoga Wood, Inc., Mountain Lake, Minn.

[21] Appl. No.: 232,994

[22] Filed: Apr. 14, 1994

[51] Int. Cl.[6] ..... B65D 43/20

[52] U.S. Cl. ..... 217/62; 217/63

[58] Field of Search ..... 217/59, 62, 63; 312/297

[56] References Cited

U.S. PATENT DOCUMENTS

| | | | |
|---|---|---|---|
| 354,277 | 12/1886 | Walker | 217/62 |
| 1,452,700 | 4/1923 | Peyer | 217/62 |
| 1,782,110 | 11/1930 | Wetzler | 217/62 |
| 1,890,999 | 12/1932 | Loftin . | |
| 1,987,018 | 1/1935 | Loftin . | |
| 2,023,465 | 12/1935 | Crocker . | |
| 2,094,740 | 10/1937 | Green . | |
| 2,107,997 | 2/1938 | Horsley | 217/62 |
| 2,136,141 | 11/1938 | Loftin et al. . | |
| 2,355,542 | 8/1944 | Loftin . | |
| 2,673,989 | 4/1954 | Veitch | 217/62 |
| 4,162,024 | 7/1979 | Shanley | 217/62 |

OTHER PUBLICATIONS

Product brochure, Haugen Furniture Company, undated.

*Primary Examiner*—Joseph M. Moy
*Attorney, Agent, or Firm*—John W. Bunch

[57] ABSTRACT

A roll-top cedar storage chest includes a tambor (7) supported by a beam (8) or bulkhead (18) for additional storage and top-loading capacity.

8 Claims, 1 Drawing Sheet

ROLL-TOP CEDAR CHEST

BACKGROUND OF THE INVENTION

A new and unique top cover for cedar chests or like boxes or box-like structures is disclosed. Other cedar chests have flat door-like lids whose tops limit their capacity for storing household goods, such as blankets, linens, etc. This new roll-top design increases capacity greatly, while simultaneously providing an "occasional chair" to sit upon. The resultant new and unique design produces a new and pleasant alternative to ordinary cedar chests.

SUMMARY OF THE INVENTION

The present invention comprises a flexible "roll-top" upper cover, suitable grooves or indented guides into which said flexible member slides, a false inside back wall or surface for storing and hiding said flexible top in the open position and a transverse beam which supports top loads should they be brought to bear on the top by sitting or storing goods on it.

DESCRIPTION OF THE PREFERRED EMBODIMENT

Figure 1:
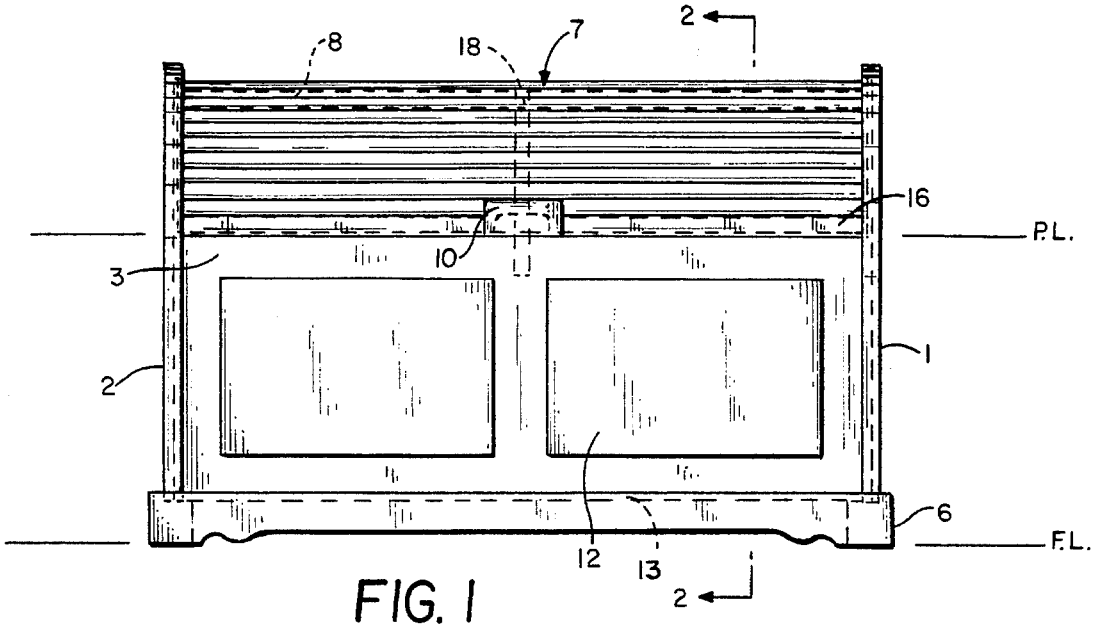
FIG. 1 is a front view of the cedar chest.

In FIG. 1, two ends 1 and 2 are spaced apart by front assembly 3 and back assembly 4. These four assemblies are mounted on base 6. The base is composed of four sculptured base pieces and a bottom panel 13. All four surfaces of the basic chest, sans tambour, are subject to sculpting and decorative paneling 12.

Figure 2:
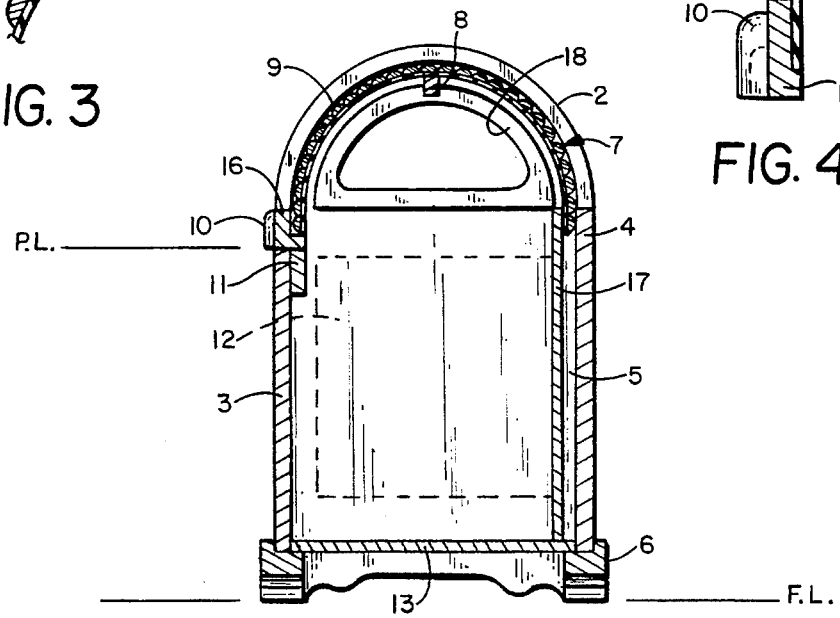
FIG. 2 is a sectional view of the cedar chest taken along lines 2—2 of FIG. 1 in the direction of the arrows.

In FIG. 2, false back 17 is installed inside the chest to provide an unobstructed space 5 for storage of flexible tambour 7 when the top is rolled back. Beam 8 is a support for top down-loading when sitting on the unit or draping articles over the top when it is closed. The tambour stops upon opening when it comes to rest against the inside bottom of the provided cavity.

Suitable grooves 9 are milled in each end to guide the tambour.

Figure 3:
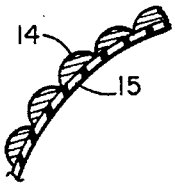
FIG. 3 is an end view of a standard tambour (flexible cover).

FIG. 3 shows the thin strips 14 attached to a flexible rubberized canvas sheet 15.

Figure 4:
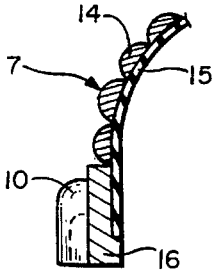
FIG. 4 shows how the tambour is attached to the leading edge slat.

FIG. 4 shows how an opening handle 10 is attached to slat 16 and how the slat is attached to the flexible tambour.

In FIGS. 1 and 2, F.L. is Floor line and P.L. is parting line of roll-top and top of front assembly 3. 11 is a doubler or stiffener and is used when length of cedar chest requires more sturdy construction.

The specifications of the preferred embodiment should not be taken as a limitations of the scope of appended claims.

I claim:

1. A storage chest having a load-bearing, rolltop cover, which comprises:

a pair of laterally spaced-apart, upright end walls;

an upright front wall secured between said end walls;

an upright back wall secured between said end walls in transversely spaced-apart relationship with said front wall in order to define a primary storage cavity therein;

said end, front and back walls each having top and bottom edges;

base means including a bottom wall secured to the bottom edges of said end, front and back walls for closing the bottom of the primary storage cavity;

a tambour having opposite sides, and front and back ends;

said tambour including a plurality of slats attached to a flexible sheet;

an upright inside wall secured between said end walls within the primary storage cavity in order to define with said back wall a secondary cavity for receiving said tambour;

means including arcuate grooves in opposing surfaces of said end walls for receiving the sides of said tambour and guiding said tambour between an extended position covering the primary storage cavity and a retracted position substantially stored in the secondary cavity;

means secured to the front end of said tambour for manually actuating said tambour between extended and retracted positions; and means including a longitudinal beam extending between said end walls below the grooves therein for vertically supporting said tambour against top loads when in the extended position.

2. The storage chest of claim 1, wherein said tambour includes:

a front slat at the front end, said manual actuating means being secured to said front slat;

a plurality of generally parallel, relatively narrower adjacent slats extending to the back end; and a flexible sheet attached to said slats.

3. The storage chest of claim 1, further including an internal lining of cedar material.

4. The storage chest of claim 1, further including a longitudinal stiffener associated with said front wall.

5. A storage chest having a load-bearing, rolltop cover, which comprises:

a pair of laterally spaced-apart, upright end walls;

an upright front wall secured between said end walls;

an upright back wall secured between said end walls in transversely spaced-apart relationship with said front wall in order to define a primary storage cavity therein;

said end, front and back walls each having top and bottom edges;

base means including a bottom wall secured to the bottom edges of said end, front and back walls for closing the bottom of the primary storage cavity;

a tambour having opposite sides, and front and back ends;

said tambour including a plurality of slats attached to a flexible sheet;

an upright inside wall secured between said end walls within the primary storage cavity in order to define with said back wall a secondary cavity for receiving said tambour;

means including arcuate grooves in opposing surfaces of said end walls for receiving the sides of said tambour and guiding said tambour between an extended position covering the primary storage cavity and a retracted position substantially stored in the secondary cavity;

means secured to the front end of said tambour for manually actuating said tambour between extended and retracted positions; and means including a transverse intermediate bulkhead disposed between said end walls below the grooves therein for vertically supporting said tambour against top loads when in the extended position.

6. The storage chest of claim 5, wherein said tambour includes:

a front slat at the front end, said manual actuating means being secured to said front slat;

a plurality of generally parallel, relatively narrower slats extending to the back end; and a flexible sheet attached to said slats.

7. The storage chest of claim 5, further including an internal lining of cedar material.

8. The storage chest of claim 5, further including a longitudinal stiffener associated with said front wall.

* * * * *